US005997248A

United States Patent [19]

Ghasripoor et al.

[11] Patent Number: 5,997,248

[45] Date of Patent: Dec. 7, 1999

[54] SILICON CARBIDE COMPOSITION FOR TURBINE BLADE TIPS

[75] Inventors: Farshad Ghasripoor, Matzingen; Richard K. Schmid, Winterthur, both of Switzerland; Mitchell R. Dorfman, Smithtown, N.Y.

[73] Assignee: Sulzer Metco (US) Inc., Westbury, N.Y.

[21] Appl. No.: 09/204,182

[22] Filed: Dec. 3, 1998

[51] Int. Cl.[6] ..... F01D 11/14; F01D 11/08; B64C 11/16; B64C 27/46

[52] U.S. Cl. ..... 415/173.4; 415/173.4; 415/174.4; 416/241 B; 416/241 R; 428/404; 428/698; 427/450; 427/452

[58] Field of Search ..... 415/173.4, 174.4; 416/241 B, 241 R; 428/404, 698; 427/450, 452

[56] References Cited

U.S. PATENT DOCUMENTS

| | | | |
|---|---|---|---|
| 3,062,680 | 11/1962 | Meddings et al. . | |
| 3,723,165 | 3/1973 | Longo et al. . | |
| 3,914,507 | 10/1975 | Fustukian . | |
| 4,249,913 | 2/1981 | Johnson . | |
| 4,280,975 | 7/1981 | Ammann . | |
| 4,492,522 | 1/1985 | Rossmann et al. . | |
| 4,735,656 | 4/1988 | Schaefer et al. . | |
| 4,744,725 | 5/1988 | Matarese et al. | 415/172 A |
| 4,802,828 | 2/1989 | Rutz et al. . | |
| 4,865,252 | 9/1989 | Rotolico et al. . | |
| 4,876,941 | 10/1989 | Barnes et al. | 89/36.02 |
| 5,453,329 | 9/1995 | Everett et al. . | |
| 5,622,638 | 4/1997 | Schell et al. | 219/121.64 |
| 5,704,759 | 1/1998 | Draskovich et al. . | |

FOREIGN PATENT DOCUMENTS

| | | |
|---|---|---|
| 2 241 506 | 9/1991 | United Kingdom . |

*Primary Examiner*—F. Daniel Lopez
*Assistant Examiner*—Rhonda Barton
*Attorney, Agent, or Firm*—H. S. Ingham

[57] ABSTRACT

A granular composition is applied to tips of rotor blades utilized in a gas turbine engine wherein the blade tips rub against an abradable ceramic layer. Individual grains each have a core of silicon carbide and a layer of aluminum nitride on the core. A layer of a cladding metal may be bonded to the aluminum nitride. The composition also may include particles of cubic boron nitride and/or particles of metal alloy blended with the grains of silicon carbide.

43 Claims, 2 Drawing Sheets

SILICON CARBIDE COMPOSITION FOR TURBINE BLADE TIPS

This invention relates to gas turbine engines and to abrasive granular compositions, and particularly to abrasive granular compositions for application to turbine rotor blade tips.

BACKGROUND

A gas turbine engine includes a number of rotor sections axially aligned, each having a hub (or portion of a common hub) with a plurality of equally spaced rotor blades mounted on the hub. A shroud encompasses the blade tips with as little clearance as possible in order to minimize bypass flow of air and other gasses past the tips of the blades. The shroud is substantially coaxial, but it is very difficult to fabricate and maintain a shroud that is exactly round and located right at the blade tips, particularly with some flexing and heat expansions of the shroud during engine operations.

A common solution is to utilize a clearance sealing layer on the shroud that is abraded by the blade tips, thus producing a self-adjusting, relatively tight seal. For lower temperature sections, abradable coatings typically contain a soft metal with a soft non-metal component such as graphite, a polymer or boron nitride. In higher temperature sections a porous ceramic such as zirconia is used, such as described in U.S. Pat. No. 4,280,975. However, shroud materials, particularly ceramics, have a tendency to wear the tips of the blades. In the case of titanium blades, metallic friction against the shroud is a concern for fire.

Abrasive materials such as silicon carbide (SiC) have been provided on turbine blade tips to alleviate these problems, for example as taught in U.S. Pat. Nos. 4,492,522 and 4,802,828. SiC is considered good for the purpose because it is hard, has a high sublimation temperature and is oxidation resistant at turbine operating temperatures. However, SiC reacts with blade alloys at elevated temperatures, particularly nickel superalloys, to decompose the SiC and create deleterious by-products of silicides and free carbon. In U.S. Pat. No. 4,249,913 there is disclosed the use of SiC particles coated with alumina as a barrier against the blade alloy. However, SiC can react with alumina at high temperature in a reducing atmosphere to produce gaseous phases of SiO, CO and $Al_2O$. Also, significant differences in thermal expansion coefficients and thermal conductivities between SiC and a $Al_2O_3$ layer make the layer susceptible to thermal cracking and subsequent reaction of the exposed SiC. Moreover, $Al_2O_3$ has poor wetting by the blade alloy and is difficult to bond into it.

Boron nitride exists in several forms including cubic boron nitride ("cBN") which is very hard, second only to diamond. It has been used for abrasive particles on blade tips to cut ceramic outer air seal coatings, as taught in U.S. Pat. No. 5,704,759 and United Kingdom patent application publication No. GB 2 241 506 A. However, cBN oxidizes at the temperatures above about 850° C. which are typical of the turbine sections utilizing ceramic shrouds.

An object of the invention is to provide a novel granular composition for application to tips of rotor blades in a gas turbine engine wherein the blade tips rub against an abradable ceramic or metallic layer on a shroud encompassing the rotor blades. Another object is to provide such a composition containing silicon carbide as abrasive granules. Yet another object is to provide such a composition in which silicon carbide granules have an improved layer of protection against reaction with blade alloy. A further object is to provide such a composition of silicon carbide having a protective layer with a further improvement for bonding into the blade alloy. Another object is to provide such a composition further containing a harder run-in material. An additional object is to provide a rotor blade with a blade tip containing such a novel composition.

Yet another object is to provide a process for bonding such a novel composition to a rotor blade tip.

SUMMARY

The foregoing and other objects are achieved, at least in part, by a granular composition for application to tips of rotor blades utilized in a gas turbine engine wherein the blade tips rub against an abradable ceramic layer on a shroud encompassing the rotor blades. The composition comprises individual grains each comprising a core of silicon carbide, and a layer of aluminum nitride substantially covering the core. Preferably the composition further comprises a layer of a cladding metal bonded to the layer of aluminum nitride. In a further embodiment, the composition also comprises particles of cubic boron nitride blended with the grains of silicon carbide. In yet another embodiment, the composition further comprises particles of metal alloy blended with the grains of silicon carbide.

Objects also are achieved by a rotor blade for a gas turbine engine having a plurality of rotor blades with tips that rub against an abradable ceramic layer on a shroud encompassing the rotor blades. The rotor blade is formed of a blade member with an inner end adapted for mounting on a rotation hub and a blade tip located opposite the inner end, and an abrasive layer bonded to the blade tip. The abrasive layer comprises the above-described granular composition of silicon carbide.

Objects are further achieved by a process for bonding the abrasive layer to such a rotor blade tip, the process comprising laser fusing into the blade alloy at the blade tip the above-described granular composition. For this process the silicon carbide preferably has a granular size substantially between 200 microns and 350 microns.

DETAILED DESCRIPTION

Figure 1:
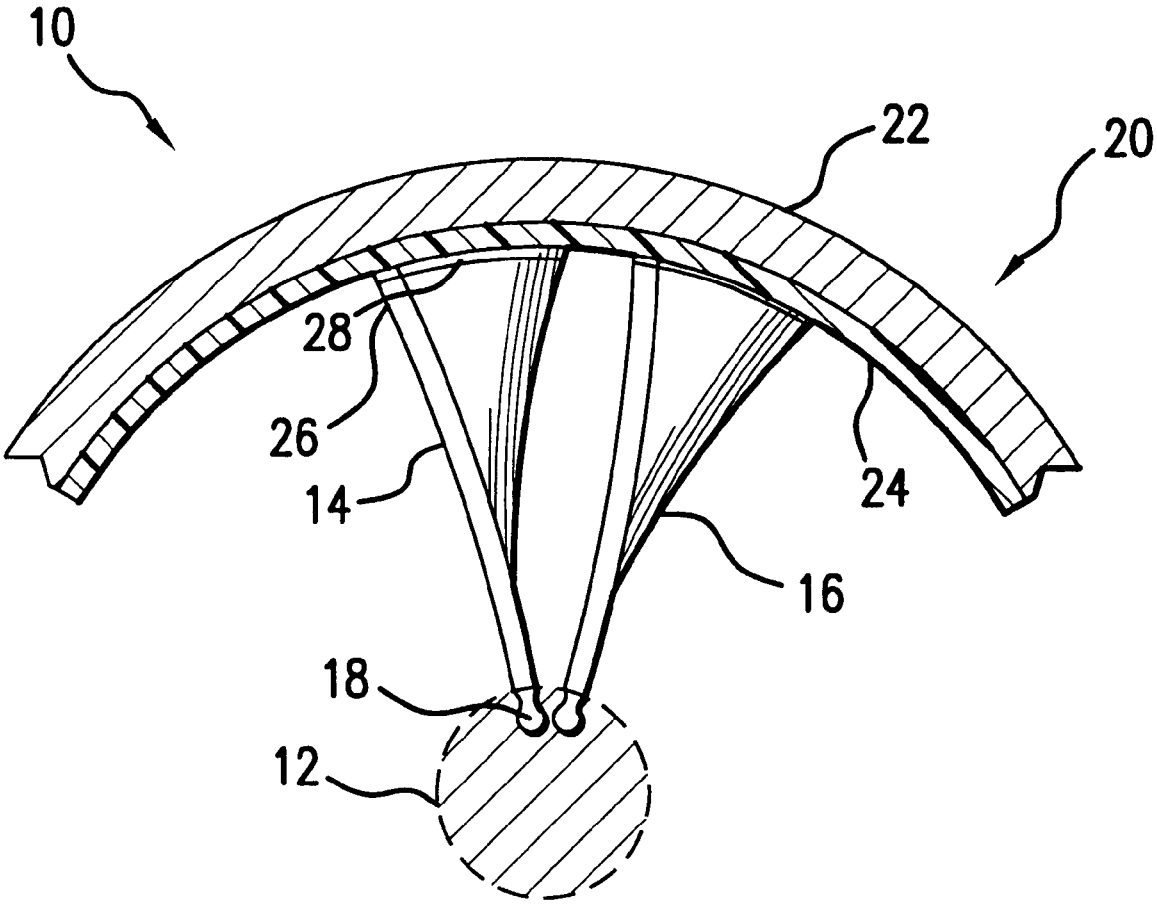
FIG. 1 is a simplified cross section of a portion of a gas turbine engine incorporating an abrasive layer of the invention on turbine blade tips.

FIG. 1 illustrates a section 10 of a gas turbine engine including a hub 12 that rotates and is connected axially to other rotor sections in the engine. Two rotor blades 14, 16 are illustrated. In an actual engine a plurality of blades are equally spaced arcuately about the hub. Each blade has an inner end, i.e. root 18, that is adapted for mounting on the hub. A substantially coaxial shroud 20 is formed of a base member 22 and an abradable coating 24, the coating being formed, for example, of a plasma sprayed zirconium oxide stabilized with yttria.

The shroud coating should be abradable which may be achieved with porosity. For example, a powder of zirconium oxide stabilized with 6% to 8% yttrium oxide and having a size generally between 10 $\mu$m and 212 $\mu$m is blended with 3% to 5% by weight of a special polymer powder. The polymer may be an acrylic resin powder, or a poly (paraoxybenzoyl) ester powder of the type disclosed in U.S. Pat. No. 3,723,165, the powder having a size between 16 μm (microns) and 176 μm. The plasma sprayed coating of the blend is heated to at least 450° C. or otherwise in place in the high temperature environment of an operating engine, so that the plastic burns out to leave a porous abradable coating of stabilized zirconia.

The tips 26 (i.e. outer ends) of the blades have an abrasive layer 28 bonded thereto. The tips are essentially as close as possible to the coating of the shroud for the abrasive layer to rub against and cut into the abradable coating, at least in some areas. Turbine blades typically are formed of nickel alloy, titanium, steel, nickel aluminides or ceramic. A commonly used blade material is a single crystal nickel alloy CMSX-4 (Ni 6.2Cr 9.5Co 5.5Al 1.0Ti 0.6Mo 6.5W 6.5Nb+Ta). The blade tips or the entire blades are often coated with a layer of MCrAlY alloy (explained below) for oxidation protection, e.g. 150 to 200 μm thick. Such a layer may be applied by any conventional or other desired means such as thermal spray, laser or electrodeposition. The blade tips may be flat or grooved ends, or knife edges. The blade configuration may be more complex, with a shroud ring affixed to inner blade ends and knife edge tips extending from outside of the ring, such that the knife edges rub against the abradable coating. As used herein and in the claims, the terms "rotor blades" and "blade tips" include such configurations.

Figure 2:
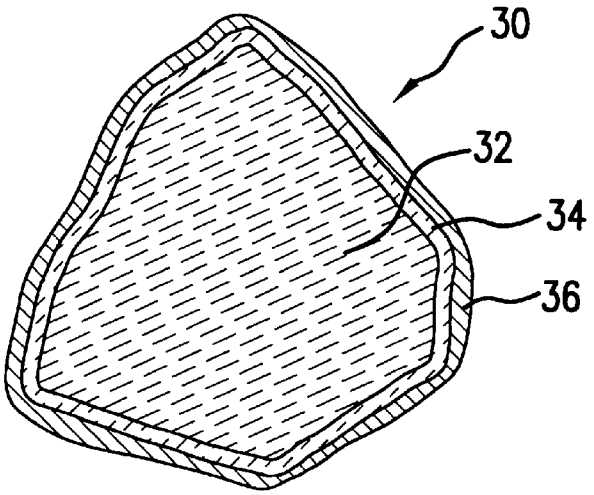
FIG. 2 is a cross section of a grain of the composition of the invention utilized for the abrasive layer of FIG. 1.

According to the present invention, the abrasive layer is formed from a granular composition. Each grain 30 (FIG. 2) of the composition has a core 32 of silicon carbide, and a first layer of aluminum nitride (AlN) 34 substantially covering the core. This granular composition may be incorporated into the blade tips by any conventional or other desired method such as by laser heating, thermal spraying, sintering, welding, furnace fusion, brazing, electrodeposition, or the like. The blade tips may have an oxidation protective coating as explained above, in which case the granular composition is merely incorporated into such a coating on the tips. Preferably, to facilitate bonding to the tips, a second layer of a cladding metal 36 is bonded to the first layer 34 of the silicon carbide granules.

The silicon carbide (SiC) particles are formed conventionally such as by crushing silicon carbide. As the carbide is brittle, the crushed particles will generally be irregular which aids in abrasiveness. The SiC should have a granular size broadly and substantially between 10 μm and 500 μm, as established and measured by screening. Specific size range is selected according to the process of application of a coating. A preferable range for laser coating is substantially between 200 μm and 350 μm, these coarser particles being particularly desirable for the cutting action.

The SiC particles are clad with aluminum nitride (AlN) by any conventional or other desired method that provides substantially full coverage, such as direct reaction of aluminum and nitrogen, carbon reduction of alumina in the presence of ammonia or nitrogen, pyrolysis of aluminum trichloride-ammonia adduct at low temperature, or chemical vapor reaction of aluminum trichloride and ammonia. The aluminum nitride need not be stoichiometric. This first cladding layer may be somewhat irregular in thickness, but should substantially cover the SiC so as to protect it from oxidation and reaction with surrounding alloy. The aluminum nitride preferably has a proportion between about 1% and 10% by weight of the silicon carbide.

Advantageously, to aid in bonding into a blade tip, the first cladding layer is further clad with a metal that should be an alloy such as of nickel or cobalt that is heat and corrosion resistant and compatible with blade alloy. The blade alloy may be, for example, a nickel base alloy such as IN718™ of Inco which nominally (by weight) is 50–55% nickel, 17–21% chromium, 4.75–5.5% niobium, 2.8–3.3 molybdenum, 0.65–1.15 titanium, 0.2–0.8 aluminum, maximum 1% cobalt, and balance iron and less than 1% other elements. For such a nickel alloy blade, preferably the cladding metal for the particles is an alloy of nickel with chromium and aluminum, more preferably a nickel alloy with about 1% to 30% chromium and 1% to 20% aluminum, by weight of the alloy. Preferably the cladding metal has a proportion between about 10% and 50% by weight of the silicon carbide. Optionally the metal alloy may contain one or more additional constituents such as yttrium to form a "NiCrAlY" which is a conventional type of alloy used in gas turbine engines. Cobalt and/or iron may replace some or all of the nickel in the alloy, the generic alloy being "MCrAlY" where "M" is Ni, Co and/or Fe, with possible addition of other elements.

Any suitable cladding method for applying the cladding metal may be used, although the cladding preferably should not contain an organic binder. For cladding with a nickel-chromium-alloy, the cladding may be effected by a process described in U.S. Pat. Nos. 3,062,680 and 3,914,507, the portions of each of these patents relevant to cladding with nickel and diffusing chromium and aluminum being incorporated herein by reference. The core particles are clad first with nickel, by suspension of the particles in a nickel ammine sulphate solution, and reducing the nickel from the solution by hydrogen at 180° C. and 2.4 MPa in the autoclave. The nickel cladding then is alloyed with chromium and aluminum by pack diffusion, for example as described in Example 7 of the aforementioned U.S. Pat. No. 3,914,507.

A resulting NiCrAl coating on the particles, for example 24.9% Ni, 0.72% Cr and 3.75% Al, by weight of the total composition including the SiC and AlN, may range from 5 μm to 10 μm thick. Some of the finer granules may be agglomerates of cladding material without SiC. These agglomerates should be removed by screening out particles below 100 Am or other methods. A further analysis of such powder (with agglomerates removed) indicated that final particles contained, in addition to the nickel alloy, 66.55% SiC and 2.90% AlN. Such a powder with 200–350 μm SiC had an average size of 340 μm.

Secondary electron microscope (SEM) observations showed that heating the particles in air at 1000° C. for 18 hours resulted in no reaction between constituents of the different cladding layers, i.e. between SiC and NiCrAl, SiC and AlN or AlN and NiCrAl. The NiCrAl suffered slight oxidation.

Figure 3:
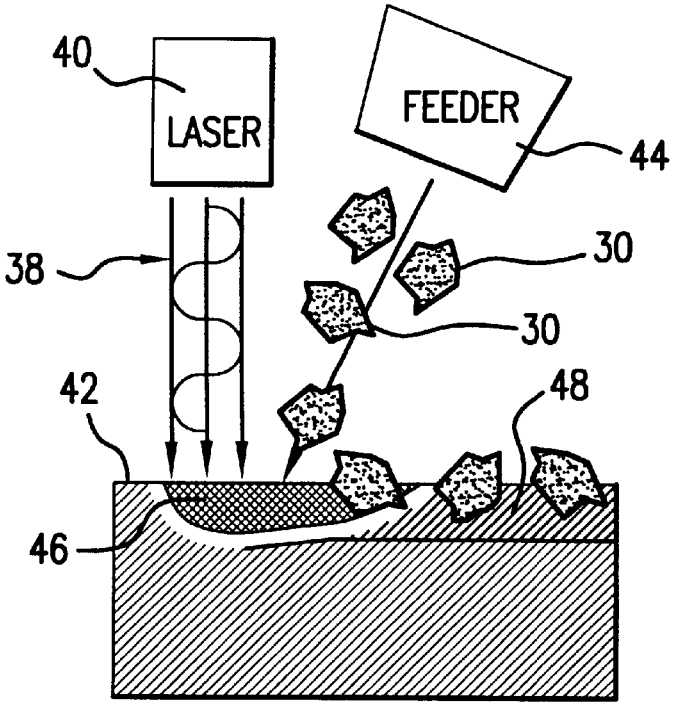
FIG. 3 is a schematic illustration of a process according to the invention for bonding the abrasive layer of FIG. 1.

A SiC granular composition of the foregoing example (including aluminum nitride and alloy layers), the SiC having a size substantially between 200 μm and 350 μm, was fused into a dummy blade tip of IN718™ by laser particle injection (FIG. 3) using a method disclosed, for example, in U.S. Pat. No. 5,453,329. In open air or an inert gas shroud (e.g. argon), a 2 kW $CO_2$ continuous wave laser beam 38 from a laser source 40 was directed to the tip surface 42 while the clad SiC granules 30 were gravity fed from a metered feeder 44 at a rate of 4.8 g/min to a region adjacent the spot of laser light. (Nearly any metered gravity type of feeder should be suitable, for example a Sulzer Metco Type 3MP feeder.) The laser at least partially melted the NiCrAl cladding alloy into the tip alloy. As the laser and feed were traversed across the tip at a rate of 100 cm/min, the melt 46 solidified in a recrystallized layer 48 was about 400 μm to 700 μm thick.

Good abradability was achieved on dummy blades in a test rig when 200–300 μgm particles of SiC protruded above the surface of the blade tip by about half of their height. Tables 1 and 2 show computations for SiC particle concentrations on dummy blade tips for optimum cutting and minimum needed to cut.

TABLE 1

| SiC Particle Size (μm) | Av. Area of One Particle ($mm^2$) | No. of Particles/ $mm^2$ for Optimum Cutting | % Area Covered by Particles |
|---|---|---|---|
| 180–200 | 0.035 | 23 | 80 |
| 250–300 | 0.050 | 16 | 80 |

TABLE 2

| SiC Particle Size (μm) | Av. Area of One Particle ($mm^2$) | Min. No. Particles/ $mm^2$ for Cutting | % Area Covered by Particles |
|---|---|---|---|
| 180–200 | 0.035 | 16 | 55 |
| 250–300 | 0.050 | 11 | 55 |

The particles may lie in a single plane or, for greater density, the particles may intermesh in different planes. The latter is preferred, providing a close packed placement is achieved. An In718 alloy dummy blade with a tip clad with the SiC granular composition was heated at 1000° C. for 18 hours. There was no discernable reaction between the constituents of the cladding layer and the blade alloy, demonstrating the AlN to be a stable diffusion barrier For other bonding processes, the particle size range should be adjusted to a conventional size suitable for the process. In the case of thermal spraying, a preferred process is a high velocity oxy-fuel (HVOF) process with a spray gun such as taught in U.S. Pat. No. 4,865,252. A suitable electrodeposition process is taught in the aforementioned European patent application publication No. 0 443 877 A1. A fusion method is taught in U.S. Pat. No. 4,735,656. For HVOF the silicon carbide should have a size generally of about 10 μm to 25 μm with a 1μm to 5 μm layer of aluminum nitride and a 5 μm to 10 μm layer of NiCrAl. A plasma thermal spraying process may utilize a size from 25 μm to 100 μm. Thus, more broadly, the particle size is in a narrower range generally between 10 and 350 microns.

The composition of SiC clad with AlN, optionally with an additional cladding metal, may be blended with another particulate material to enhance the properties of the blade tip. An advantageous addition is cubic boron nitride ("cBN") particulate. The cBN is substantially harder (4700 Vickers) than SiC (2100 to 2600 Vickers) and has a slightly higher sublimation temperature. However particles oxidize above 850° C. A combination of SiC and cBN should effect a smoother cut in the initial few hours of cutting, primarily by the cBN. The latter will gradually oxidize, leaving behind the SiC particles for the lesser cutting needed in further engine operation. The cBN may be clad similarly to SiC, but such cladding, which would be for oxidation protection, usually is not necessary as the cBN is short lived anyway. The cBN particles should have substantially the same size range as the SiC, compatible with the coating application process. The volume proportion of cBN should generally be in the range of 20% to 50% by volume based on the total of the cBN and the SiC.

It may be advantageous to apply a bonding layer of an alloy such as an MCrAlY to the blade tip before applying the SiC composition. Such a layer is applied by any conventional or other desired technique such as thermal spray, laser or electrodeposition and is, for example, about 100 μm thick.

If particles that have an outer layer of metal are applied by a process such as laser fusing, thermal spraying, brazing or welding, a mix with additional metal may be used for oxidation protection in the coating, but such a mix may not be necessary and would dilute the abrasiveness. However, if the particulate is applied by a process such as electrodeposition, another powdered material may be blended with the SiC granules as a metal matrix material to aid in the bonding. This may be any metal alloy compatible with the blade alloy and the SiC granules with the AlN and (optional) metallic cladding. For example the matrix may be simple Ni –20Cr, or a more complex alloy such as an MCrAlY as described above, for example Amdry™ 997 powder (Ni 23Co 20Cr 8.5Al 4Ta 0.6Y, –37 μm) or Amdry 995 powder (Co 32 Ni 21Cr 8Al 0.5Y, –75 +45 μm), each sold by Sulzer Metco. The size range of the matrix particles should be about 1 μm to 10 μm for electrodeposition or, for a laser or thermal spray process, the matrix particles preferably are about 10 μm to 37 μm in size.

While the invention has been described above in detail with reference to specific embodiments, various changes and modifications which fall within the spirit of the invention and scope of the appended claims will become apparent to those skilled in this art. Therefore, the invention is intended only to be limited by the appended claims or their equivalents.

What is claimed is:

1. A granular composition for application to tips of rotor blades utilized in a gas turbine engine wherein the blade tips rub against an abradable ceramic layer on a shroud encompassing the rotor blades, the composition comprising individual grains each comprising a core of a silicon carbide granule, and a layer of aluminum nitride substantially covering the core.

2. The composition of claim 1 wherein the silicon carbide has a granular size substantially between 10 microns and 500 microns.

3. The composition of claim 2 wherein the silicon carbide has a granular size substantially between 200 microns and 350 microns.

4. The composition of claim 1 wherein the aluminum nitride has a proportion between about 1% and 10% by weight of the silicon carbide.

5. The composition of claim 1 further comprising a layer of a cladding metal bonded to the layer of aluminum nitride.

6. The composition of claim 5 wherein the cladding metal is an alloy of nickel with chromium and aluminum.

7. The composition of claim 6 wherein the aluminum nitride has a proportion between about 1% and 10%, and the cladding metal has a proportion between about 10% and 50%, each proportion being by weight of the silicon carbide.

8. The composition of claim 7 wherein the silicon carbide has a granular size substantially between 200 microns and 350 microns.

9. The composition of claim 1 further comprising particles of cubic boron nitride blended with the grains of silicon carbide.

10. The composition of claim 9 wherein the particles of cubic boron nitride have a proportion between about 20% and 50% by volume based on the total of the silicon carbide and the cubic boron nitride.

11. The composition of claim 9 wherein the particles of cubic boron nitride have a granular size substantially the same as that of the silicon carbide.

12. The composition of claim 1 further comprising particles of metal alloy blended with the grains of silicon carbide.

13. A rotor blade for a gas turbine engine having a plurality of rotor blades with tips that rub against an abradable ceramic layer on a shroud encompassing the rotor blades, the rotor blade comprising a blade member with an inner end adapted for mounting on a rotation hub and a blade tip located opposite the inner end, and an abrasive layer bonded to the blade tip, the abrasive layer comprising a granular composition comprising individual grains each comprising a core of a silicon carbide granule, and a layer of aluminum nitride substantially covering the core.

14. The rotor blade of claim 13 wherein the silicon carbide has a granular size substantially between 10 microns and 500 microns.

15. The rotor blade of claim 14 wherein the silicon carbide has a granular size substantially between 200 microns and 350 microns.

16. The rotor blade of claim 13 wherein the aluminum nitride has a proportion between about 30% and 50% by weight of the silicon carbide.

17. The rotor blade of claim 13 wherein the blade member is formed of a selected blade alloy, and the granular composition further comprises a layer of a cladding metal bonded to the layer of aluminum nitride, the cladding metal being at least partially fused into the blade alloy.

18. The rotor blade of claim 17 wherein the blade alloy is a nickel alloy, and the cladding metal is an alloy of nickel with chromium and aluminum.

19. The rotor blade of claim 18 wherein the aluminum nitride has a proportion between about 30% and 50%, and the cladding metal has a proportion between about 10% and 50%, each proportion being by weight of the silicon carbide.

20. The rotor blade of claim 19 wherein the silicon carbide has a granular size substantially between 200 microns and 350 microns.

21. The rotor blade of claim 17 wherein the abrasive layer is formed by laser fusing the granular composition into the blade alloy at the blade tip.

22. The rotor blade of claim 21 wherein the silicon carbide has a granular size substantially between 10 microns and 500 microns.

23. The rotor blade of claim 22 wherein the silicon carbide has a granular size substantially between 200 microns and 350 microns.

24. The rotor blade of claim 21 wherein the aluminum nitride has a proportion between about 30% and 50% by weight of the silicon carbide.

25. The rotor blade of claim 21 wherein the blade alloy is a nickel alloy, and the composition further comprises a layer of a cladding metal bonded to the layer of aluminum nitride, the cladding metal being an alloy of nickel with chromium and aluminum.

26. The rotor blade of claim 25 wherein the aluminum nitride has a proportion between about 30% and 50%, and the cladding metal has a proportion between about 10% and 50%, each proportion being by weight of the silicon carbide.

27. The rotor blade of claim 26 wherein the silicon carbide has a granular size substantially between 200 microns and 350 microns.

28. The rotor blade of claim 13 further comprising particles of cubic boron nitride blended with the grains of silicon carbide.

29. The rotor blade of claim 28 wherein the particles of cubic boron nitride have a proportion between about 20% and 50% by volume based on the total of the silicon carbide and the cubic boron nitride.

30. The rotor blade of claim 28 wherein the particles of cubic boron nitride have a granular size substantially the same as that of the silicon carbide.

31. The rotor blade of claim 13 wherein the composition further comprises a metal alloy matrix for the grains of silicon carbide.

32. A process for bonding an abrasive layer to a blade tip of a rotor blade for a gas turbine engine having a plurality of rotor blades with tips that rub against an abradable ceramic layer on a shroud encompassing the rotor blades, the rotor blade comprising a blade member with an inner end adapted for mounting on a rotation hub and the blade tip located opposite the inner end, and the blade member being formed of a selected blade alloy, wherein the process comprises laser fusing into the blade alloy at the blade tip a granular composition comprising individual grains each comprising a core of silicon carbide, a first layer of aluminum nitride substantially covering the core, and a second layer of a cladding metal bonded to the first layer, and the cladding metal being at least partially fused into the blade alloy.

33. The process of claim 32 wherein the silicon carbide has a granular size substantially between 10 microns and 500 microns.

34. The process of claim 33 wherein the silicon carbide has a granular size substantially between 200 microns and 350 microns.

35. The process of claim 32 wherein the aluminum nitride has a proportion between about 30% and 50% by weight of the silicon carbide.

36. The process of claim 32 wherein the composition further comprises a layer of a cladding metal bonded to the layer of aluminum nitride.

37. The process of claim 36 wherein the cladding metal is an alloy of nickel with chromium and aluminum.

38. The process of claim 37 wherein the aluminum nitride has a proportion between about 30% and 50%, and the cladding metal has a proportion between about 10% and 50%, each proportion being by weight of the silicon carbide.

39. The process of claim 38 wherein the silicon carbide has a granular size substantially between 200 microns and 350 microns.

40. The process of claim 32 wherein the composition further comprises particles of cubic boron nitride blended with the grains of silicon carbide.

41. The process of claim 40 wherein the particles of cubic boron nitride have a proportion between about 20% and 50% by volume based on the total of the silicon carbide and the cubic boron nitride.

42. The process of claim 40 wherein the particles of cubic boron nitride have a granular size substantially the same as that of the silicon carbide.

43. The process of claim 32 wherein the composition further comprises particles of metal alloy blended with the grains of silicon carbide.

* * * * *